United States Patent [19]

Vural et al.

[11] 4,014,620

[45] Mar. 29, 1977

[54] VIBRATORY TAMPER

[75] Inventors: Gülertan Vural, Emmelshausen; Udo Carle, Hohr-Grenzhausen, both of Germany

[73] Assignee: Koehring BmbH-Bomag Division, Boppard (Rhine), Germany

[22] Filed: Aug. 28, 1975

[21] Appl. No.: 608,772

[30] Foreign Application Priority Data

Aug. 28, 1974 Germany ..... 2441180

[52] U.S. Cl. ..... 404/133

[51] Int. Cl.[2] ..... E01C 19/34

[58] Field of Search ..... 404/133, 102, 103, 113, 404/117

[56] References Cited

UNITED STATES PATENTS

| | | | |
|---|---|---|---|
| 3,756,735 | 9/1973 | Linz | 404/133 |
| 3,759,624 | 9/1973 | Hundey et al. | 404/133 |
| 3,802,791 | 4/1974 | Ubel et al. | 404/133 |
| 3,817,646 | 6/1974 | Opderbeck | 404/133 |

*Primary Examiner*—Henry S. Jaudon
*Attorney, Agent, or Firm*—Spencer & Kaye

[57] ABSTRACT

A compact and stable vibratory tamper of relatively low height comprises a crank case, a laterally mounted motor which is arranged to impart a linear reciprocating motion to an intermediate member via a planetary gear arrangement, a crankshaft, and a crank arm, and a tamping foot which is moved by the intermediate member by means of at least two oppositely acting springs which act between the intermediate member and the tamping foot and which overlap at least partially in the axial direction.

13 Claims, 4 Drawing Figures

VIBRATORY TAMPER

This invention relates to vibratory tampers of the kind comprising a crank case, a laterally mounted motor which is arranged to impart a linear reciprocating motion to an intermediate member via a gear, a crankshaft, and a crank arm, and a tamping foot which is moved by the intermediate member by means of at least two oppositely acting springs which act between the intermediate member and the tamping foot.

An example of such a vibratory tamper is disclosed in German Auslegeschrift No. 1,220,647, and in this example the gear, which is housed in the crank case, is a two-stage reduction gear comprising three axially offset gear shafts arranged one above the other. The output gear shaft constitutes an overhung crankshaft, which is coupled by the crank arm to the reciprocating intermediate member. This member is guided in a tubular extension of the tamping foot extending towards the crank case, and the tubular extension is guided in an outer tube extending from the crank case towards the tamping foot. From opposite sides of the intermediate member, as considered in the direction of the movement, a spring extends to abutments on the tamping foot and its tubular extension, and the reciprocating linear movement of the intermediate member is transmitted via the springs to the tamping foot, which is thereby set in vibration.

A main disadvantage of this known vibratory tamper is its great height and its high center of gravity, which frequently makes the machine uncomfortable to handle and encourages a tendency for it to tilt laterally, which increases the risk of accidents. The height furthermore restricts the use of the machine. For example, it is not possible to compact a lean concrete base inside a wall shuttering using such a vibratory tamper since the lowest shutter supports begin at too low a level.

The aim of the present invention, therefore, is to provide a vibratory tamper of the kind described which can be constructed so that it has, in comparison with the known construction, a much lower height and lower center of gravity. This aim is achieved by modifying those features which predominantly influence the standing height of the crank case, namely the gear with axially offset gear shafts and the springs disposed one behind another, so that, according to the invention, the gear comprises a planetary gear having its output connected to the crankshaft, and the oppositely acting springs overlap at least partially in the axial direction. While the planetary gear makes it possible for the crankshaft to be disposed without any axial offsetting relative to the driving motor, this saving in structural height is further improved by the overlapping of the springs. This enables all those parts of the vibratory tamper which affect the overall height and center of gravity to be disposed lower down, which simplifies handling and significantly reduces the tendency for the machine to tilt and the consequent risk of accident. At the same time, the planetary gear makes possible a more favorable dynamic behavior.

Although it is possible to mount the oppositely acting springs coaxially with each other, it is preferred to dispose them alongside each other relative to the direction of movement. This has the advantage of a simple and easy construction and leads to a particularly favorable space utilisation if guide rods are provided for the intermediate member and the tamping foot. In this case, the oppositely acting springs preferably comprise a number of outer springs which are spaced apart around at least one inner spring which is arranged to act in opposition to the outer springs, and the guide rods are disposed alternately with the outer springs concentrically about the axis of the inner spring. In general, three guide rods and three outer springs are sufficient to provide a uniform peripheral support. Alternatively, it would be possible to arrange the outer springs coaxially about the guide bars, but this would have no additional advantage with regard to the overall height of the machine.

In one practical embodiment of the invention, the intermediate member comprises an upper component with guide heads surrounding the guide rods, and a lower component connected to the upper component by a connecting member, the inner spring surrounding the connecting chamber member and acting between the lower component and a cup-shaped spring support which is attached to the tamping foot and which extends towards the crank casing, and the outer springs acting between the tamping foot and the upper component of the intermediate member. A machine constructed in this manner is easily handled, is space-saving and is easy to assemble.

A particularly favorable and compact, but nevertheless easily handled, form of the planetary gear comprises an inner wheel coupled to the motor, for example by a centrifugal clutch, and journalled in the hollow portion of a hollow intermediate shaft which serves as the output shaft of the gear, an outer wheel rigidly attached to the crank case, and at least one intermediate planetary wheel between the inner and outer wheels and coupled to the intermediate shaft. In this case the intermediate shaft is preferably connected in a rotationally keyed manner to the crankshaft which is journalled overhung in the crank case.

Apart from the measures described with regard to the planetary gear and the spring arrangement, which influence the overall height and position of the center of gravity to an equal extent, it is also possible for further measures to be taken which basically influence only either the overall height or the center of gravity position. For example, the machine may be provided with height-adjustable guide forks, which can be lowered to enter extremely low working spaces, or with a motor unit having a suspended cylinder, which directly results in a lower center of gravity and also lesser height dimensions so that the machine becomes still more stable.

An example of a vibratory tamper in accordance with the present invention is illustrated in the accompanying drawings, in which.

Figure 1:
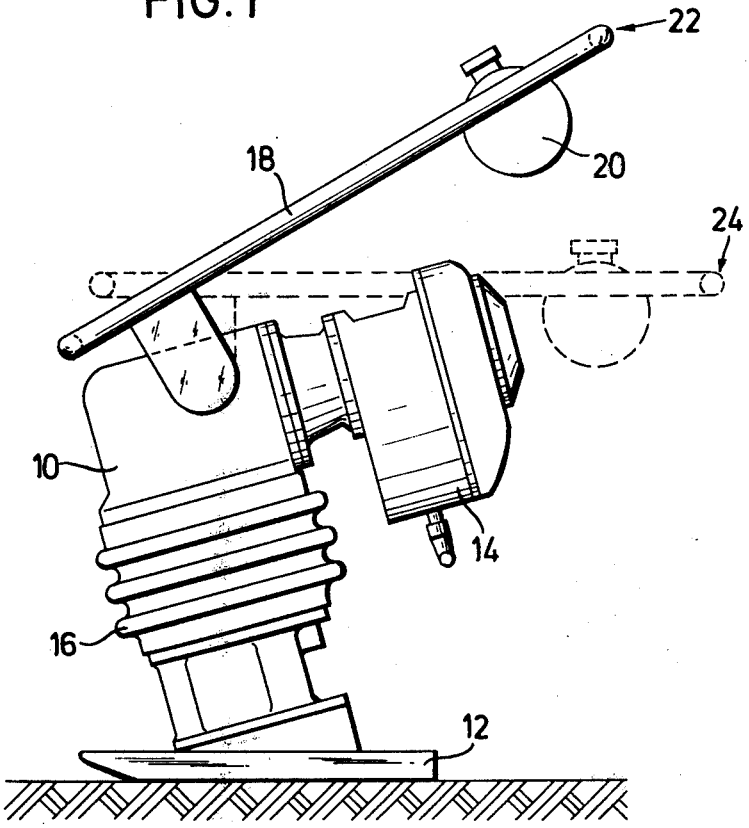
FIG. 1 is a diagramatic side view of the tamper.

The vibratory tamper shown in the drawings is of comparatively compact construction, and comprises at the top a crank case 10 and at the bottom a tamping foot 12 which is connected to the crank case 10 by means of a flexible bellows 16 which acts as a dirt cover. A driving unit 14 comprising an internal combustion motor and a suspended cylinder is mounted laterally on the crank case 10, and pivotally mounted on top of the crank case 10 is a guide fork 18 which extends laterally away from the case 10 and which is capable of being between a standard position 22 and a lower position 24. A tank 20 is attached to the guide fork 18. Due to the measures to be explained in more detail below, the vibratory tamper can be built compactly with a minimal overall height of less than 600mm, whereas known vibratory tampers usually have an overall height of about 1000mm.

Figure 2:
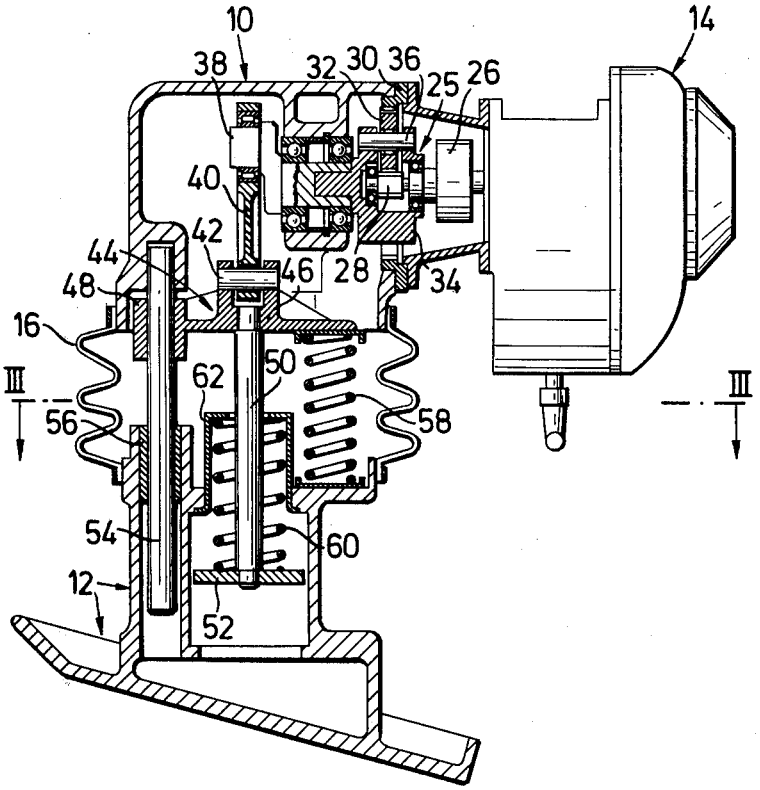
FIG. 2 is a detailed vertical section through the vibratory tamper.

As shown in FIG. 2, a centrifugal clutch 26 is connected between the driving unit 14 and the inner planet wheel 28 of a planetary gear 25. The planet wheel 28 is journalled at both ends in the hollow portion of a hollow intermediate shaft 34 and is in engagement with at least one circulating planetary intermediate wheel 32. The wheel 32 is situated in a radial slot in the intermediate shaft 34 and is coupled to this shaft 34 by means of a bolt-like dog 36. The planetary intermediate wheel 32 can revolve about the dog 36 and is in engagement with an outer planetary wheel 30 which is rigidly mounted on the crank case 10. Preferably, the planetary outer wheel 30 constitutes a built-in component, which is clamped during assembly of the vibratory tamper between the crank case 10 and the driving unit 14 or, as shown, an intermediate member. In this manner, it is relatively easy to construct and can be introduced removably into the crank case 10.

At its end remote from the clutch 26, the intermediate shaft 34 has a narrowed portion, which is keyed into a socket at one end of a crankshaft 38, so that the shafts 34 and 38 rotate together. The crankshaft 38 is journalled in a part of the crank case 10 and has its crank end connected to a short crank arm 40 which imparts a linear reciprocating motion to an intermediate member 44 by means of a pin joint 42.

The intermediate member 44 consists of an upper component 46 and a lower component 52 which are axially spaced from each other and connected by a connecting member 50. The upper component 46 has three cylindrical guide heads 48 displaced at 120° intervals around its periphery, each guide head 48 being longitudinally slidably located on one of three parallel guide rods 54. The guide rods 54 are firmly attached to the crank case 10 and serve to guide the intermediate member 44 and the tamping foot 12 as these are reciprocated, the foot 12 having an upwardly extending extension provided with three guide sleeves 56 displaced by 120° and each engaging around one of the guide rods 54.

Figure 3:
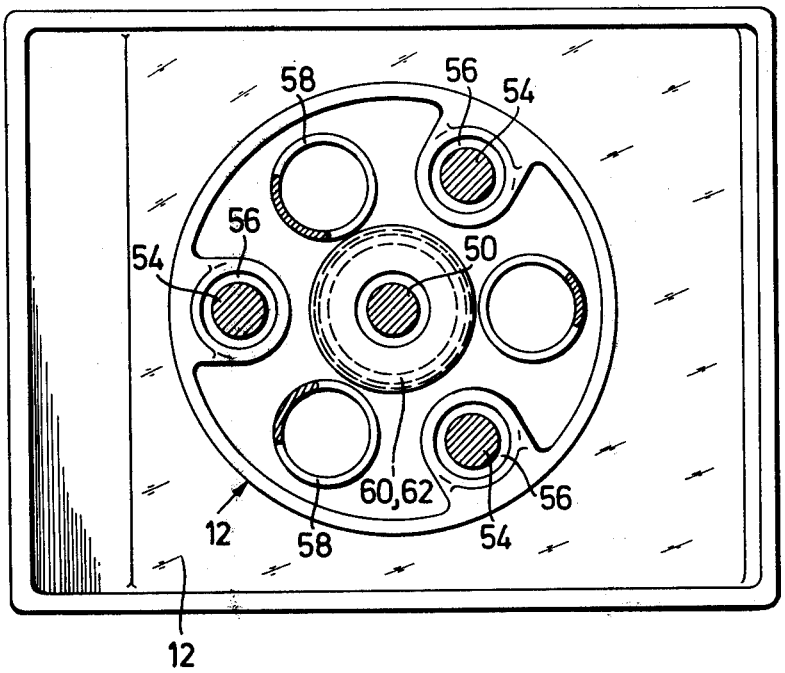
FIG. 3 is a cross-section taken along the line 111-13 111 in FIG. 2.
Figure 4:
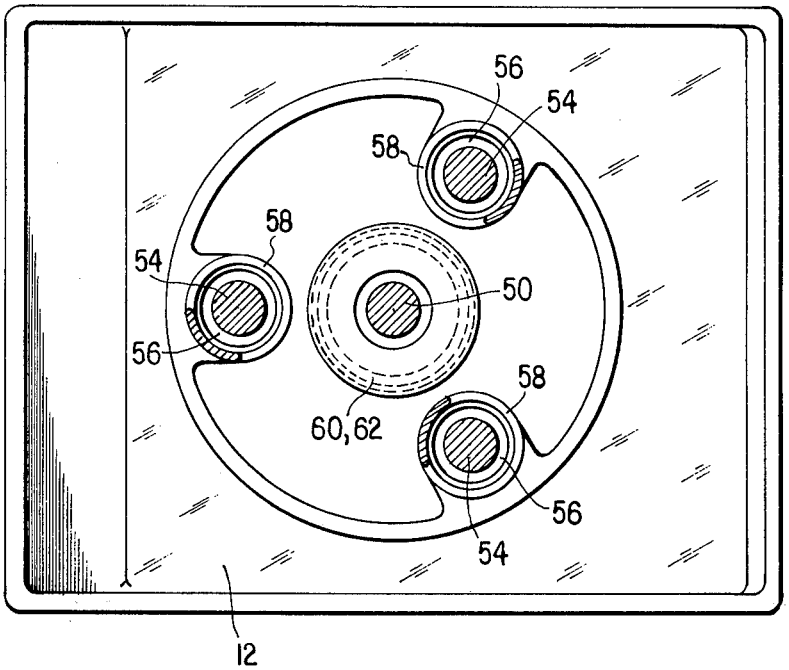
FIG. 4 is a view similar to that of FIG. 3 of a modified arrangement according to the invention.

Alternating with the guide rods 54 around the periphery of the component 46 there are three outer springs 58, displaced at 120° intervals from each other, which bear between the upper component 46 and the upward extension of the tamping foot 12. The arrangement of these outer springs 58 in relation to the guide rods 54 can be seen clearly from FIG. 3. In addition there is a centrally located inner spring 60 which surrounds the connecting member 50 and bears between the lower component 52 and the inside of a cup-shaped or hat-shaped spring support 62 through which the connecting member 50 extends. The spring support 62 is connected to the upward extension of the tamping foot 12 and is arranged so that itself, and therefore the spring 60 also, overlaps the outer springs, 58 in the axial direction. The compression spring coupling, constituted by the springs 58 and 60 between the tamping foot 12 and the intermediate member 44 requires only a comparatively small structural height, due to the axial overlapping relationship of the springs 58 and 60. As a variant of the embodiment shown, the springs 58 may completely overlie the spring 60, or be disposed concentrically around the guide rods 54, the latter variant being shown in FIG. 4, but it should always be ensured tha the necessary movement clearance is maintained between the individual parts of the vibratory tamper.

The flexible bellows 16 is attached at its upper end to the crank case 10 and at its other end to the upward extension of the tamping foot 12. The bellows serves as a protection against the entry of particles of dirt and the escape of lubricating and damping oil.

In operation, the comparatively high rotational speed of the drive shaft from the motor is reduced by the planetary gear 25, and the crankshaft 38 causes a reciprocating motion of the intermediate member 44 along the guide rods 54. The oscillation forces are transmitted via the spring coupling 58, 60 to the tamping foot 12, which in turn executes vibratory movements relative to the substantially stationary crank case 10, in order to tamp and compact the material situated underneath the foot 12 of the tamper. Apart from the low overall height and the low center of gravity resulting from the uniaxial planetary gear and the axially overlapping springs, the overall height can be still further reduced by means of the pivotal guide fork 18, while the tendency to tilt is reduced by the motor unit with its suspended cylinder.

We claim:

1. In a vibratory tamper comprising a crank case, a motor unit laterally mounted on said crank case, a gear unit, a crankshaft driven by said motor unit through said gear unit, a movable intermediate member, a crank arm connecting said intermediate member to said crankshaft for reciprocation of said intermediate member, guide means for guiding said intermediate member linearly when said intermediate member is reciprocated, a movable tamping foot, and at least two oppositely acting springs mounted between said intermediate member and said tamping foot whereby motion is transmitted to said tamping foot from said intermediate member, the improvement wherein said gear unit is a planetary gear comprising an inner wheel, a hollow intermediate shaft connected to said crankshaft and having a hollow portion, means journalling said inner wheel in said hollow portion, an outer wheel rigidly attached to said crank case, and at least one intermediate planet wheel coupled to said intermediate shaft and engaging between said inner and outer wheels, said tamper including means drivingly connecting said motor unit to said inner wheel, and wherein said oppositely acting springs overlap at least partially in the axial direction.

2. A vibratory tamper as claimed in claim 1, wherein said oppositely acting springs are disposed alongside one another with respect to the direction of motion.

3. A vibratory tamper as claimed in claim 1, wherein said oppositely acting springs are disposed coaxially with one another.

4. A vibratory tamper as claimed in claim 2, wherein said oppositely acting springs comprise a plurality of outer springs and at least one inner spring, said outer springs being disposed in spaced-apart relationship around said inner spring, and said inner spring acting in opposition to said outer springs.

5. A vibratory tamper as claimed in claim 4, wherein said guide means comprises a plurality of guide rods and said movable tamping foot is mounted on said guide rods to guide said tamping foot in linear motion, said guide rods being disposed alternately with said outer springs concentrically about the axis of said inner spring.

6. A vibratory tamper as claimed in claim 4, wherein said guide means comprises a plurality of guide rods, and said outer springs are disposed coaxially about said guide rods.

7. A vibratory tamper as claimed in claim 5, wherein there are three of said guide rods and three of said outer springs.

8. A vibratory tamper as claimed in claim 6, wherein there are three of said guide rods and three of said outer springs.

9. A vibratory tamper as claimed in claim 5, wherein said intermediate member comprises an upper component, guide heads attached to said upper component and surrounding said guide rods, a lower component, and a connecting member connecting said upper component to said lower component, and wherein a cup-shaped spring support is attached to said tamping foot, said inner spring surrounding said connecting member and acting between said lower component and said cup-shaped spring support while said outer springs act between said tamping foot and said upper component.

10. A vibratory tamper as claimed in claim 9, wherein said guide rods are fixed with respect to said crank case and said guide heads are slidable on said guide rods, and said tamping foot is provided with guide sleeves which are also slidable on said guide rods.

11. A vibratory tamper as claimed in claim 1, wherein said crankshaft is mounted overhung in said crank case, and said crankshaft and said intermediate shaft are provided with interengaging means whereby said intermediate shaft is connected ina torsionally keyed manner to said crankshaft.

12. A vibratory tamper as claimed in claim 1, wherein said motor unit has a suspended cylinder.

13. A vibratory tamper as claimed in claim 1, including a height-adjustable guide fork attached to a said crank case.

* * * * *